United States Patent [19]

Rallo

[11] Patent Number: 5,027,677

[45] Date of Patent: Jul. 2, 1991

[54] ELECTRICIAN'S UTILITY HAMMER

[76] Inventor: John Rallo, 3575 Chaplou Dr., St. Louis, Mo. 63129

[21] Appl. No.: 478,434

[22] Filed: Feb. 12, 1990

Related U.S. Application Data

[63] Continuation-in-part of Ser. No. 309,810, Feb. 13, 1989, abandoned.

[51] Int. Cl.[5] ..... B25D 1/00

[52] U.S. Cl. ..... 81/26; 81/20

[58] Field of Search ..... 81/26, 20, 21, 22, 23, 81/24, 25, 27

[56] References Cited

U.S. PATENT DOCUMENTS 2,821,222 1/1958 Mount ..... 81/20

4,290,583 9/1981 Lombardi ..... 81/20

*Primary Examiner*—Frederick R. Schmidt

*Assistant Examiner*—Lawrence Cruz

*Attorney, Agent, or Firm*—Rogers, Howell & Haferkamp

[57] ABSTRACT

An electrician's utility hammerhead for use in striking objects like nails, prying objects from adjacent surfaces, and puncturing objects like knock-out plugs of electrical junction and fuse boxes, comprises a forward section with a flat striking surface primarily suited for striking nail heads, a middle section for attachment to a handle and having left and right side surfaces configured for use in striking objects, and a rear section that tapers rearwardly to a rear surface of reduced area for striking objects in confined areas, and for knocking out electrical junction box knock-out plugs of various sizes, and including a fulcrum protuberance on the top surface of the rear section for providing increased leverage when using the hammerhead as a prying tool.

16 Claims, 1 Drawing Sheet

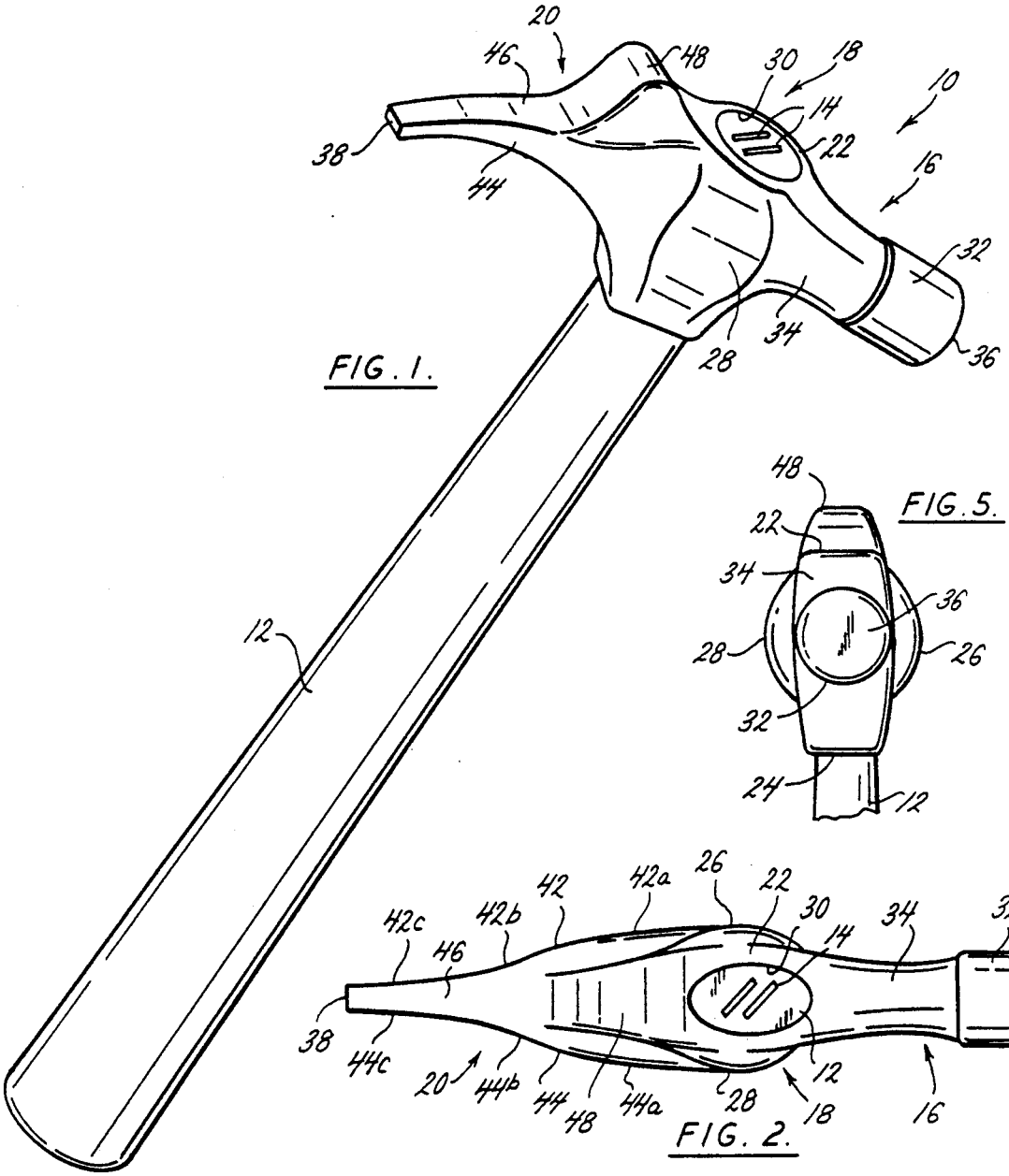
FIG. 1.
FIG. 5.
FIG. 2.
FIG. 3.
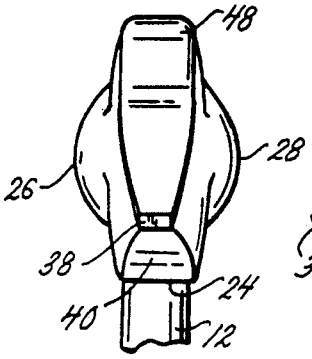
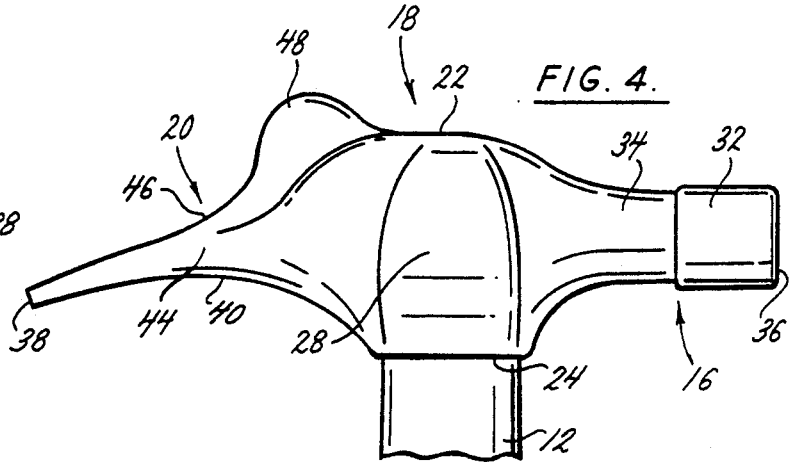
FIG. 4.

ELECTRICIAN'S UTILITY HAMMER

This is a continuation-in-part of patent application Ser. No. 07/309,810, now abandoned, filed Feb. 13, 1989.

BACKGROUND OF THE INVENTION (1) Field of the Invention

The present invention pertains to an electrician's utility hammer for use in striking, prying, and puncturing objects. In particular, the invention pertains to a unique hammerhead that is provided with a front face and two side faces for striking objects, and a back face specifically configured for use in prying objects with increased leverage and in knocking out the different sized knock-out plugs of conventional electrical junction boxes.

(2) Description of the Related Art

Conventional hammerheads of the type most commonly used in carpentry are formed at one end with a flat face for striking objects such as nails, and formed at the opposite end with a claw for removing nails. The shank of the hammerhead that connects the front face and the rear claw is commonly provided with an eye or socket extending through the hammerhead for receiving a handle inserted into the head. Although the shape of the conventional hammerhead is well designed for its use in carpentry, it is not ideally suited for performing some of the specialized tasks involved in installing electrical systems in structures.

In installing electrical junction boxes in residential and commercial structures, an electrician can make use of a conventional hammer for driving in nails to hold junction and fuse boxes to wall studs and floor joists of the structures. However, the face of a conventional hammerhead is too large to be used to knock out the knock-out plugs of conventional junction and fuse boxes. It is common practice for an electrician to use a screwdriver as a chisel, and striking the screwdriver with the hammer to knock out the knock-out plugs. However, in installing junction and fuse boxes on the wall studs and floor joists of buildings under construction, there is often only a limited area to work in between adjacent wall studs and floor joists. In this limited working space it is very difficult to position a screwdriver on the knock-out plug of a junction box or a fuse box, and then strike the opposite end of the screwdriver to knock out the knock-out plugs. A hammerhead specifically designed with a striking face dimensioned small enough to knock out the smaller of the two nested knock-out plugs provided on conventional electrical boxes, while also providing a larger striking surface for knocking out the larger of the two nested knockout plugs of conventional electrical boxes would overcome the disadvantages encountered in employing a conventional hammerhead to perform electrical installation work.

Problems are also often encountered when an electrician uses a conventional hammerhead to remove previously installed electrical junction and fuse boxes from the wall studs and floor joists of a building structure. Because of the curvature of the nail claw of a conventional hammerhead, it is often difficult to insert the end of the claw between a wall stud or floor joist and the junction box without the handle of the hammer contacting the junction box and preventing the insertion of the claw. To overcome this problem, the end of the hammer claw can be placed against a protruding surface of the electrical box away from its connection to the wall stud or floor joist, and then a block of wood can be placed between the top of the hammerhead and the wall stud or floor joist to provide a fulcrum surface for the hammerhead to rock against to pry the installed junction box from the wall stud or floor joist. Very often a properly sized block of wood is not immediately available to the electrician, and the electrician's work is slowed down while he searches for a block of wood to be used as the fulcrum in removing the junction box from the stud or joist. A hammerhead having a claw or prong with a built-in fulcrum would overcome this disadvantage of conventional hammerheads.

Furthermore, the nail claw on conventional hammerheads commonly has a width that is wider than any other point on the hammerhead. The width of the end of the nail claw often prevents it from being inserted in the limited spaces involved in performing electrical contracting work. For example, the nail claws of conventional hammers cannot be used to knock out the nested knock-out plugs of conventional junction or fuse boxes because the width of the ends of the hammer claw is too wide to permit the insertion of the claw through the knock-out holes of conventional junction boxes. A hammerhead with a narrow claw specifically designed to be inserted into the smaller knock-out holes of conventional junction and fuse boxes would overcome this disadvantage of prior art hammerheads.

It is also often necessary for the electrician to use his hammer to knock out sections of wall board to gain access to the space between adjacent wall studs behind the wall board. The striking face of a conventional hammerhead can be used for this purpose, but the work goes slowly because the striking face of a hammerhead will generally knock out only a section of wall board the size of the striking face itself. The electrician can turn his hammer sideways and use the side surface of the hammerhead to break away portions of the wall board. However, due to the close proximity of the side surface of a conventional hammerhead and the handle inserted in the head, the handle of the hammer may come into contact with a wall stud or the wall board being broken away, causing the handle to break. A hammerhead provided with side surfaces that project outward from the hammer handle would overcome this disadvantage of conventional hammerheads.

The electrician's utility hammer of the present invention overcomes the above described disadvantages of prior art hammerheads by providing a unique hammerhead structure that incorporates a front section having a flat striking surface, a rear section formed as a narrow pry bar with a narrow striking surface at its distal end and a projecting fulcrum protuberance on its top surface, and a middle section joining the front and rear sections and having striking surfaces projecting outward from its opposite sides away from a handle inserted into the middle section of the hammerhead.

SUMMARY OF THE INVENTION

The electrician's utility hammerhead of the present invention is generally formed of three different sections combined unitary in a single hammerhead. A front section of the head is primarily used in striking and driving objects such as nails. A rear section of the hammerhead is also used in striking and driving objects, only the striking surface of the rear section is much smaller than that of the front section, enabling the rear section of the hammerhead to be used in striking objects in confined areas. The rear section of the hammerhead is also used in prying and puncturing objects. The middle section of the hammerhead joins the front and rear sections and is also designed to be used in striking objects.

The middle section of the electrician's utility hammerhead has opposed top and bottom surfaces, and left and right side surfaces. A handle receiving socket extends through the middle section between the bottom and top surfaces. The bottom and top surfaces of the middle section are generally flat. The left and right side surfaces of the middle section protrude outward to present a convex surface on the opposite sides of the hammerhead. The convex protuberances on the opposite sides of the head are specifically designed to be used in striking objects, while preventing the occurrence of a handle inserted into the hammerhead from coming into contact with the object being struck and possibly breaking.

The front section of the electrician's hammerhead includes a neck portion that is formed unitary with the middle section of the head and extends forward, tapering to a poll at the distal end of the front section. The poll is cylindrical, and the front surface of the poll is flat, enabling the hammerhead to be used in driving objects such as nails.

The rear section of the electrician's hammerhead is formed unitary with the middle section of the head and extends rearward from the middle section, tapering to a flat striking surface at the distal end of the rear section. The rear section striking surface is much smaller than the front section striking surface, and is specifically dimensioned to be inserted into the smaller knock-out holes of conventional junction and fuse boxes. These smaller knock-out holes commonly have a diameter of only $\frac{7}{8}$ of an inch. The reduced dimensions of the rear surface enable the rear section of the electrician's hammerhead to be used in knocking out the smaller knock-out plugs of conventional electrical junction boxes and fuse boxes. The left and right sides of the rear section of the hammerhead are arranged at three different relative angles between the two sides as the rear section extends rearward from the middle section to the rear striking surface. The three different relative angles between the left and right sides of the rear section form a necked down portion of the rear section between the rear striking surface of the hammerhead and the middle section of the head. The relative angle between the left and right sides of the rear section at the necked down portion is specifically dimensioned to enable the rear section to be used to knock out the knock-out ring of a knockout plug of the type that comprises a small circular plug surrounded by a larger concentric knock-out ring. These larger knock-out plugs commonly have a diameter of 1-$\frac{1}{8}$ inches. The hammerhead of the invention is also useful in knocking out knock-out plugs of various sizes, larger and smaller than the most frequently used sizes discussed above. The overall structure of the rear section of the hammerhead is generally curved downward to enhance the usefulness of the rear section in prying objects. The top surface of the rear section is provided with a protuberance between the middle section and the necked down portion of the rear section of the hammerhead. The protuberance extends upward from the top surface of the rear section, above the top surface of the middle section of the hammerhead. The protuberance functions as a built-in fulcrum providing additional leverage to the rear section when it is used in prying.

BRIEF DESCRIPTION OF THE DRAWINGS

Further objects and features of the present invention are revealed in the following detailed description of the preferred embodiment of the invention and in the drawing figures wherein:

FIG. 1 is a perspective view of the electrician's utility hammerhead of the present invention with a conventional wooden handle installed in the head of the invention;

FIG. 2 is a plan view of the hammerhead of the invention;

FIG. 3 is a rear elevation view of the hammerhead of the invention;

FIG. 4 is a right side elevation view of the hammerhead of the invention; and FIG. 5 is a front elevation view of the hammerhead of the invention.

DESCRIPTION OF THE PREFERRED EMBODIMENT

FIG. 1 shows the electrician's utility hammerhead 10 of the present invention with a wooden handle 12 installed in the head. The drawing figures show a wooden handle installed in the head and secured in place by a pair of wedges 14 driven in the end of the handle. It should be understood that the handle shown is exemplary and does not make up a part of the invention, and that the hammerhead of the invention may be used with a variety of different types of handles without departing from the scope of the invention.

The electrician's hammerhead of the invention is generally comprised of a front section 16, a middle section 18, and a rear section 20, with each of the three sections being specifically designed to perform specific tasks.

The middle section 18 of the electrician's hammerhead includes a top 22 and bottom 24 surface, and opposite left 26 and right 28 side surfaces A handle receiving socket 30 extends through the middle section between the bottom and top surfaces of the section. The socket 30 is dimensioned to firmly receive the end of a handle inserted into the socket. The bottom and top surfaces of the middle section are generally flat, but the left and right side surfaces 26, 28 are formed as convex surfaces that protrude outward from the middle section The protruding left and right side surfaces 26, 28 of the middle section are provided to enable the sides of the hammerhead to be used in striking objects, while positioning the handle 12 inserted into the head far enough away from the striking surfaces 26, 28 to avoid having the handle come into contact with the surface being struck and possibly breaking the handle.

The front section 16 of the hammerhead of the invention is formed unitary with the middle section of the head and extends forward from the middle section to a cylindrical poll 32 at the distal end of the hammerhead front section. The poll 32 is connected to the middle section 18 of the hammerhead by a tapering neck portion 34 of the head front section 16. The distal end of the poll 32 terminates in a substantially flat front end surface 36 that is generally perpendicular to the poll axis. The flat front end surface 36 is specifically designed for striking and driving objects such as nails.

The rear section 20 of the hammerhead of the present invention is formed unitary with the middle section 18 of the head and extends rearward from the middle section, tapering to a rear end surface 38 of the hammerhead. The rear section 20 has a substantially flat bottom surface 40, left and right side surfaces 42, 44, and a top surface 46. The left and right side surfaces 42, 44 of the rear section 20 taper toward each other as the rear section extends back from the middle section to the rear end surface 38 of the hammerhead. The left and right side surfaces 42, 44 of the rear section are also arranged at three different relative angles between each other as the side surfaces extend back to the rear end surface 38. The three different relative angles between the side surfaces divide the rear section of the hammerhead into three separate segments. The first segment of the rear section of the hammerhead is positioned immediately rearward from the middle section of the head and is defined by the relative angle between first portions 42*a*, 44*a*, of the left and right side surfaces 42, 44, of the hammer rear section respectively. The second segment of the rear section of the hammerhead is positioned immediately rearward of the first segment of the rear section and is defined by portions of the left and right side surfaces that converge toward each other at a greater rate than the left and right side surfaces in the first segment of the rear section. The portions of the left and right side surfaces 42*b*, 44*b*, that make up the second segment of the rear section are arranged at a relative angle between the surface portions 42*b*, 44*b*, that is greater than the relative angle between the left and right side surface portions 42*a*, 44*a*, of the first segment of the rear section of the hammerhead. The left and right side surfaces 42*b*, 44*b*, that define the second segment of the rear section also define a necked down portion of the rear section that is used in knocking out electrical junction box and fuse box knock-out plugs of the type that comprise a smaller knock-out plug centered in and concentric to a larger knock-out ring commonly found on conventional junction and fuse boxes. The rear end surface of the hammerhead is used to knock out the smaller plug, and then the necked down portion of the rear section is used to knock out the remaining ring surrounding the inner plug once the smaller inner plug has been removed. The third segment of the rear section of the hammerhead is defined by the portions of the left and right side surfaces 42*c*, 44*c*, that extend rearward from the left and right side surfaces of the second segment of the rear section. The portions of the left and right side surfaces 42*c*, 44*c* that make up the third segment are arranged with a relative angle between the surfaces that is smaller than the relative angle between the portions of the left and right side surfaces 42*b*, 44*b*, that define the second segment or necked down portion of the rear section of the hammerhead. The arrangement of the three different segments of the left and right side surfaces 42, 44, of the rear section of the head is best seen in FIG. 2. From FIG. 2, it can be seen that the larger relative angle between the second segments 42*b*, 44*b* of the left and right side surfaces present more of a rearward facing surface than do the left and right side surfaces of the first and third segments of the rear section. The rearward facing surface of the portions of the left and right side surfaces 42*b*, 44*b* that make up the necked down portion of the hammer rear section provide the contact surface that is utilized in knocking out the larger knock-out rings of the concentric type of plugs often found on conventional electrical junction boxes and fuse boxes. The left and right side surfaces 42, 44 of all three segments of the rear section taper toward the flat rear end surface 38 of the hammerhead. The reduced area of the rear end surface 38 enables the rear section of the hammerhead to be used in striking objects in confined areas and in knocking out the smallest knock-out plugs of conventional electrical junction and fuse boxes.

From FIG. 4 it can be seen that the overall structure of the rear section 20 of the hammerhead curves downward from its unitary connection with the middle section 18 of the head. The bottom surface 40 of the rear section, together with a portion of the top surface 46 of the rear section also taper toward the rear end surface 38 of the rear section. The tapering of the top and bottom sections toward the rear end surface enables the rear section 20 of the hammerhead to be inserted into confined areas to be used as a prying tool.

A protuberance 48 extends upward from the top surface 46 of the rear section above the first segment of the rear section. The protuberance 48 extends above the top surface 22 of the middle section 28 and acts as a fulcrum providing additional leverage to the rear section 20 of the hammerhead when the head is used as a prying tool. The protuberance 48 being positioned close to the rear end surface 38 of the rear section 20, increases the leverage of the electrician's hammer of the present invention over that of conventional hammers. In using the rear section 20 of the hammerhead for prying objects from a wall stud or floor joist, only a small degree of handle movement is required to raise the rear end surface 38 of the rear section from the wall stud or floor joist due to the positioning of the protuberance 38.

While the present invention has been described by reference to a specific embodiment, it should be understood that modifications and variations of the invention may be constructed without departing from the scope of the invention defined in the following claims.

What is claimed is:

1. A hammerhead adapted to be used in striking, prying, and puncturing objects, the head comprising:

a middle section having a top, a bottom, and left and right sides;

a front section formed unitary with the middle section and extending in a forward direction from the middle section to a flat front end of the hammerhead adapted for striking objects; and a rear section formed unitary with the middle section and extending in a rearward direction from the middle section to a rear end of the hammerhead adapted for striking, puncturing, and prying objects, the rear section having a top, a bottom, and left and right sides, and being formed in three distinct segments including a first segment formed unitary with the middle section and extending in a rearward direction from the middle section, the first segment having left and right sides arranged at a relative angle such that the left and right sides converge toward each other in the rearward direction; a second segment formed unitary with the first segment and extending in a rearward direction from the first segment, the second segment having left and right sides arranged at a relative angle such that the left and right sides of the second segment converge toward each other in the rearward direction at a rate greater than the left and right sides of the first segment; and a third segment formed unitary with the second segment and extending in a rearward direction from the second segment to the rear end of the hammerhead, the third segment having left and right sides arranged at a relative angle such that the left and right sides of the third segment converge toward each other in the rearward direction at a rate smaller than the left and right sides of the second segment.

2. The hammerhead of claim 1 comprising:

the relative angle between the left and right sides of the first segment being equal to the relative angle between the left and right sides of the third segment.

3. The hammerhead of claim 1 comprising:

the relative angle between the left and right sides of the first segment being different from the relative angle between the left and right sides of the third segment.

4. The hammerhead of claim 1 comprising:

the top of the rear section of the hammerhead having a protuberance extending upward therefrom between the middle section and the second segment.

5. The hammerhead of claim 1 comprising:

the middle section having a handle receiving hole extending through the middle section between the bottom and the top of the middle section.

6. The hammerhead of claim 1 comprising:

the rear section of the hammerhead being curved in a downward direction as it extends rearward from the middle section, the curvature of the rear section enhancing its usefulness in prying objects.

7. The hammerhead of claim 4 comprising:

the protuberance extending upward from the top surface of the rear section past the top of the middle section, the protuberance being arranged to serve as a fulcrum when the rear section of the hammerhead is used for prying.

8. The hammerhead of claim 5 comprising:

the middle section of the hammerhead having convex left and right sides, the left and right sides of the middle section being curved outward between the bottom and top of the middle section, thereby adapting the left and right sides of the middle section for use in striking objects without interference from a handle inserted into the handle receiving hole of the middle section.

9. A hammerhead adapted to be used in striking, prying, and puncturing objects, the head comprising:

a middle section having a top, a bottom, and right and left sides, and having a handle receiving hole extending through the middle section between the bottom and the top of the middle section;

a front section formed unitary with the middle section and extending in a forward direction from the middle section to a front end surface of the hammerhead adapted for striking objects; and a rear section formed unitary with the middle section and extending in a rearward direction from the middle section to a rear end surface of the hammerhead adapted for striking, prying, and puncturing objects, the rear section having a top surface with a protuberance extending upward from the top surface above the top of the middle section of the hammerhead, the protuberance being arranged to serve as a fulcrum when the rear section of the hammerhead is used for prying; and the rear section of the hammerhead having a bottom and left and right sides, the left and right sides of the rear section being arranged at three different relative angles between each other as the rear section extends rearward from the middle section to the rear end surface, the three different relative angles between the left and right sides defining first, second, and third segments of the rear section between the middle section and the rear end surface, respectively.

10. The hammerhead of claim 9 comprising:

the middle section of the hammerhead having protruding surfaces of the left and right sides of the head, the protruding left and right side surfaces being adapted for use in striking objects without interference from a handle inserted into the handle receiving hole of the middle section.

11. The hammerhead of claim 9 comprising:

the protuberance extending from the top surface of the first segment of the rear section between the middle section of the hammerhead and the second segment of the rear section.

12. The hammerhead of claim 9 comprising:

the relative angle between the left and right sides of the second segment of the rear section of the hammerhead being larger than the relative angles between the left and right sides of the first and third segments of the rear section of the hammerhead.

13. A hammerhead adapted for use in installing and removing electrical junction boxes, the hammerhead comprising:

a middle section having protruding left and right sides and a socket adapted to receive a handle, the socket extending entirely through the middle section from a bottom of the section to a top of the section;

a forward section formed unitary with and extending in a forward direction from the middle section, the forward section tapering from the top and bottom of the middle section and the left and right sides of the middle section to a cylinder shaped end, the cylinder shaped end having a flat forward end surface adapted for striking objects; and a rearward section formed unitary with and extending in a rearward direction from the middle section, the rearward section having left and right sides that are angled toward each other and converge to a flat rearward end surface adapted for striking, prying and puncturing objects, the rearward section being formed in three distinct segments including a first segment formed unitary with the middle section and extending in a rearward direction from the middle section, the first segment having left and right sides arranged at a relative angle such that the left and right sides converge toward each other in the rearward direction; a second segment formed unitary with the first segment and extending in a rearward direction from the first segment, the second segment having left and right sides arranged at a relative angle such that the left and right sides of the second segment converge toward each other in the rearward direction at a rate greater than the left and right sides of the first segment; and a third segment formed unitary with the second segment and extending in a rearward direction from the second segment to the rear end of the hammerhead, the third segment having left and right sides arranged at a relative angle such that the left and right sides of the third segment converge toward each other in the rearward direction at a rate smaller than the left and right sides of the second segment, the arrangement of the left and right sides of the second segment of the rear section providing a contact surface adapted for striking and punching.

14. The hammerhead of claim 13 comprising:

the relative angle between the left and right sides of the third segment of the rearward section being different from the relative angle between the left and right sides of the first segment of the rearward section.

15. The hammerhead of claim 13 comprising:

the rearward section having a top and a bottom surface, the top surface having a protuberance extending upward from the top surface of the hammerhead.

16. The hammerhead of claim 13 comprising:

the rearward section having a top and a bottom, the top having a protuberance between the middle section of the hammerhead and the second segment of the rearward section, the protuberance being arranged to serve as a fulcrum when the rear section of the hammerhead is used for prying.

* * * * *